United States Patent [19]

Yamada et al.

[11] Patent Number: 4,958,191

[45] Date of Patent: Sep. 18, 1990

[54] DEVELOPING DEVICE

[75] Inventors: Takanobu Yamada; Noboyuki Kawai; Takeru Kinoshita, all of Osaka, Japan

[73] Assignee: Minolta Camera Co., Ltd., Osaka, Japan

[21] Appl. No.: 331,693

[22] Filed: Mar. 31, 1989

[30] Foreign Application Priority Data

Apr. 4, 1988 [JP] Japan ..... 63-83502

[51] Int. Cl.[5] ..... G03G 15/01; G03G 15/06

[52] U.S. Cl. ..... 355/245; 355/326; 355/327

[58] Field of Search ..... 355/326, 327, 245

[56] References Cited

U.S. PATENT DOCUMENTS

| | | | |
|---|---|---|---|
| 4,713,673 | 12/1987 | Kessoku | 355/327 X |
| 4,728,987 | 3/1988 | Diola et al. | 355/245 |
| 4,743,938 | 5/1988 | Ohno et al. | 355/327 |
| 4,841,329 | 6/1989 | Kasamura et al. | 355/326 X |

FOREIGN PATENT DOCUMENTS 61-217072 9/1986 Japan .

*Primary Examiner*—A. T. Grimley
*Assistant Examiner*—Matthew S. Smith
*Attorney, Agent, or Firm*—Willian Brinks Olds Hofer Gilson & Lione

[57] ABSTRACT

A disconnecting mechanism or a driving force switching mechanism provided in a developing device functions so as to transmit a driving force from a driving source to a developer stirring mechanism only correlatively with a movement of each developing unit from a developer supply location adjacent to an image support member to a developer non-supply position away from the image support member. The disconnecting mechanism or the driving force switching mechanism functions so as to transmit a driving force from the driving source both to the developer stirring mechanism and a developing roll correlatively with the movement of each developing unit from the developer non-supply position to the developer supply location.

15 Claims, 6 Drawing Sheets

DEVELOPING DEVICE

BACKGROUND OF THE INVENTION

1. Technical Field of the Invention

The present invention relates to a developing device provided with a plurality of developing units for use in image forming apparatuses such as color copying machines, color printers and copying machines which are arranged for selectively forming monocolor images of different colors.

2. Brief Description of Related Art

Generally, a color copying machine is designed for forming colored images by using four colored developers, and a developing device used for the copying machine is provided with a plurality of developing units accommodating different colored developers. The developing units are disposed in one of the following three methods.

(1) Stationary Method: Each developing unit is disposed around a photoconductor.

(2) Rotary Method: Each developing unit is disposed on a rotary support member, and a desired developing unit is positioned at a developing location opposite to a photoconductor by rotating the rotary support member.

(3) Reciprocative Movement Method: Each developing unit is disposed on a reciprocative movement support member, and a desired developing unit is positioned at a developing location opposite to a photoconductor by reciprocatively moving the reciprocative movement support member.

The stationary method has a problem that the diameter of photoconductor becomes large since each one of the developing units has to be positioned opposite to the surface of the photoconductor coincidentally at equal spaces. Moreover, there occurs attenuation variation of electrostatic latent images with the passage of time because of the difference in distance between a developing location and the position where each colored electrostatic latent image is formed, which has to be rectified.

The rotary method, which is one of the moving methods as against the stationary method, is able to solve the above-mentioned problems inherent in the stationary method. However, there are problems that toner supply can not be performed efficiently since developer tends to easily fall out of a developing unit since the rotary support member is rotated and that toner is supplied only to a developing unit positioned at a predetermined rotational position. Moreover, it is difficult to always rotate a toner stirring means in the developing unit.

The reciprocative movement method needs to provide larger space than that of the rotary method in the direction of reciprocating movement, however, it can solve the problems inherent in the rotary method. Especially, it is designed for stirring and supplying toners to each developing unit even when developing operation is not being performed. It is, therefore, very advantageous for use in forming colored images where more toners are consumed than the case when black and white images are formed.

Incidentally, in a color image forming apparatus, images which occupy much dark color portions are formed and consumes large amount of toner. Accordingly, if the toner is not sufficiently stirred, the density of toner may be lowered partially. Moreover, if the toner is not stirred sufficiently, the amount of electrification of toner is lowered thereby inviting fogging on images and toner scattering since the toner supply is inevitably increased. In order to deal with the problem, it is arranged to continuously perform toner stirring operation by a stirring means for the developing units which are not under developing process by keeping them under an operating state.

For instance, Japanese Published Patent Application TOKKAI SHO No. 61-217072 discloses a device which is designed for driving a developer stirring means when a rotary support member is rotated with a developing roll rotatively driven at a low speed at the same time. However, if a developing unit is always kept under an operating state, toner is scattered from the part of developing roll and stains the inside of a machine and the leading end of a developing unit opposite to a photoconductor since the developing unit is not faced to the photoconductor. Moreover, the toner adhered to the leading end of the developing unit is attracted by electric potential on the side of the photoconductor when the developing unit approaches the position adjacent to the photoconductor thereby causing stained images. In order to avoid such troubles, it may be considered to operate the stirring means only by stopping the action of the developing roller when developing process is not performed. However, it necessitates to provide a clutch and a special actuator with its control means for switching the clutch, which inevitably invites a rise in manufacturing cost since the color image forming apparatus is provided with a number of developing units. The structure disclosed in the above patent application is limited to a rotary method only, and sufficient stirring effect can not be obtained since toner is stirred only when a developing unit is moved.

SUMMARY OF THE INVENTION

The main object of the present invention is to provide a developing device which is capable of stirring developer sufficiently by stopping the action of a developing roll and actuating a stirring means only for a developing unit which is not performing developing operation so that a special actuator and its control means are not required.

Another object of the present invention is to provide a developing device which is capable of surely switching over to a driving state by only a stirring means when a developing unit is not performing developing operation by mechanically interlocking with the movement of each developing unit between a developer supply location where a developing unit is positioned adjacent to a photoconductor and a developer non-supply position where a developing unit is away from the photoconductor.

A further object of the present invention is to provide a developing device which is capable of simply and surely switching over to a driving state by only a stirring means when a developing unit is not performing developing operation by mechanically interlocking with a positional changeover of each developing unit between a developing non-operation position at a developing position where a developing unit is away from a photoconductor and a developing operating location at a developing position where a developing unit is positioned at a developing location.

These and other objects and features of the present invention will become more apparent from the following description taken in conjunction with the accompanying drawings which illustrate specific embodiments of the invention.

DESCRIPTION OF THE PREFERRED EMBODIMENT

An embodiment of the present invention will now be described below with reference to FIGS. 1 through 10.

Figure 1:
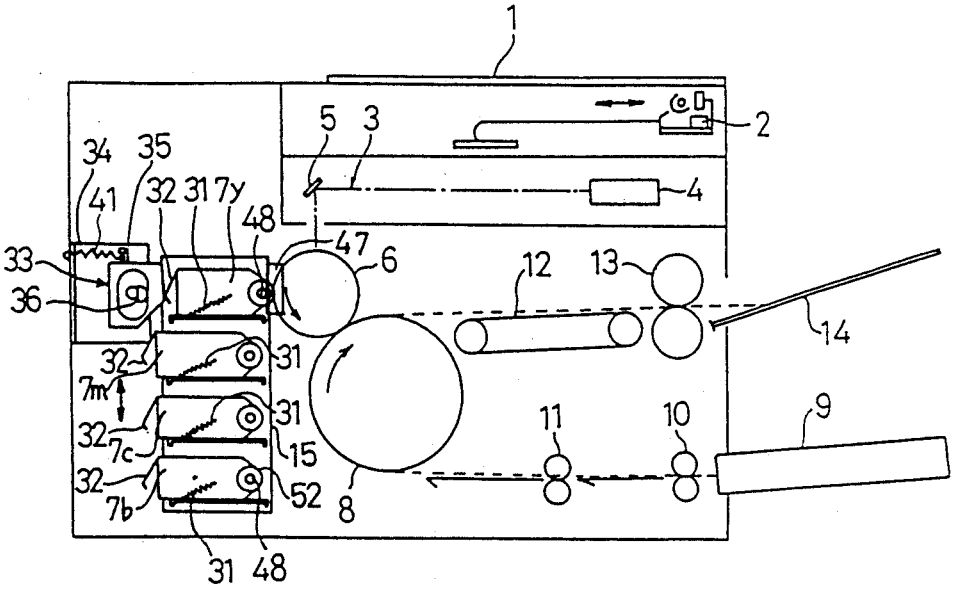
FIG. 1 is a schematic structural view showing an embodiment of the present invention which is applied to a color copying machine.

FIG. 1 shows the whole structure of a color copying machine to which the present invention is applied. In FIG. 1, an original placed on an original glass table 1 is read as color signals of three primary colors by a CCD line sensor 2. Each color signal is converted into four signals of Y (yellow), M (magenta), C (cyan) and B (black) by an image processing circuit and its output signal is transmitted to a laser optical system 3.

From a laser light generating device 4 in the laser optical system 3, laser light for forming images of each color corresponding to the signals of Y, M, C and B is irradiated. The laser light is then directed through a reflector 5 to a photoconductor 6 which rotates in the direction of arrow, and image exposure is performed.

On the surface of the photoconductor 6, a latent image is formed by the image exposure. For the latent image formed corresponding to the signal Y, yellow toner Y is supplied from Y developing unit 7*y* and a yellow toner image is formed on the photoconductor 6. In the same manner, each colored toner is supplied from M developing unit 7*m*, C developing unit 7*c*, and B developing unit 7*b* thereby forming magenta toner image, cyan toner image and black toner image respectively for the latent images formed corresponding to the signal M, signal C and signal B.

A sheet of copy paper fed from a paper cassette 9 and transported by transport rollers 10, 11 is wrapped around a transfer drum 8. Onto the paper wrapped around the transfer drum 8, each colored toner image on the photoconductor 6 is successively transferred by rotation of the transfer drum 8 with required number of rotations. The toner images of each color being transferred are composed on the copy paper and a colored toner image is formed thereon. The copy paper on which a colored toner image is formed is separated from the transfer drum 8 and is then transported through a transfer belt 12 to a fixing roller 13 where the colored toner image is fixed and then discharged to a discharge tray 14.

Figure 2:
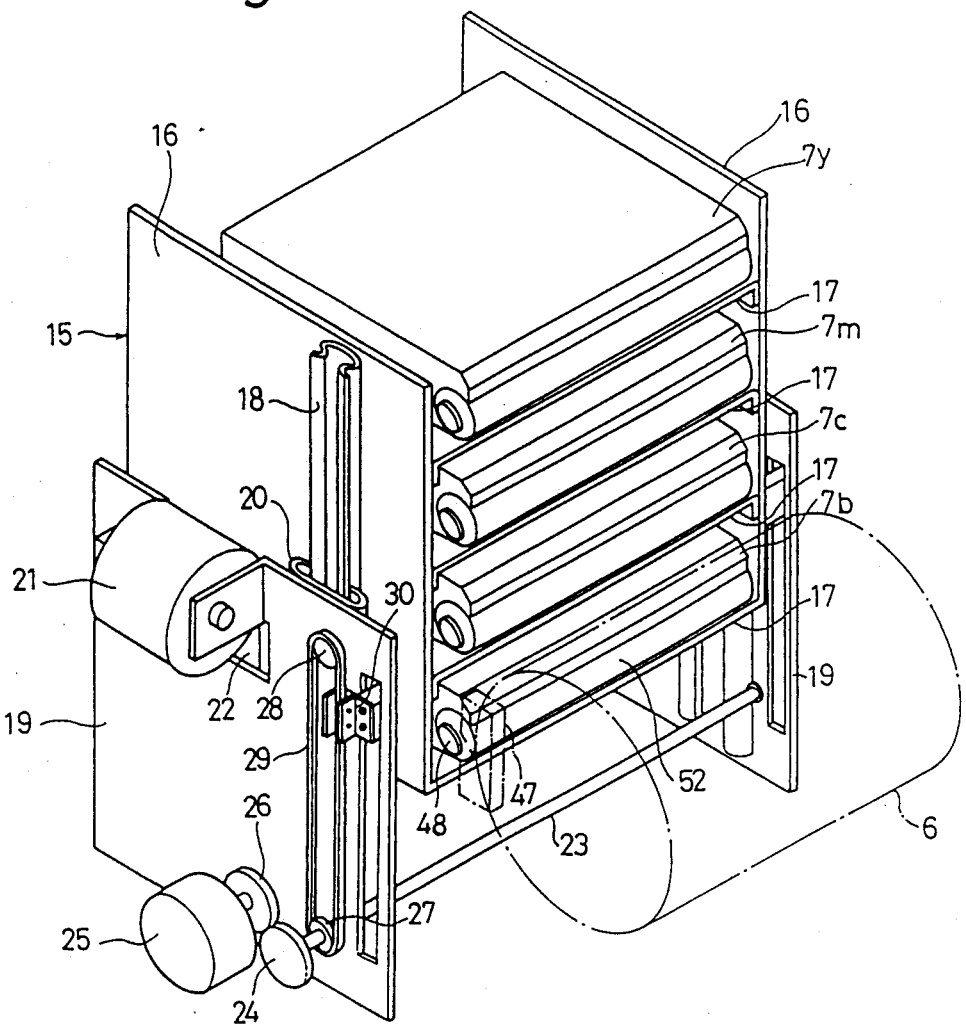
FIG. 2 is an enlarged perspective view showing a developing device of a copying machine.

Each color developing unit, 7*y*, 7*m*, 7*c* and 7*b* (hereinafter marked as developing unit 7 when each developing unit is generically called) is vertically supported by an elevation support member 15 in four stages. As shown in FIG. 2, the elevation support member 15 is provided with two sheets of sideboard 16 and four sheets of developing unit support board 17. On each one of the developing unit support boards 17, each developing unit 7 is placed, and they are movably supported and guided back and forth.

The elevation support member 15 is provided with rails 18 mounted on the sideboards 16 and fitted into rails 20 mounted on a pair of stationary boards 19 fixed on the main body of the machine. The elevation support member 15 is vertically movably supported and guided in a fitting relation between the rails 18, 20.

A balancer 21 is mounted on the stationary board 19, and the tip portion of a spring sheet 22 of the balancer 21 is attached to the elevation support member 15 so as to always maintain a balanced state irrespective of any vertical position of the elevation support member 15.

A driving shaft 23 is hung at the lower portion of the stationary boards 19, and a gear 24 fixed to one end of the shaft is engaged with a driving gear 26 of a DC motor 25. Adjacent to both ends of the driving shaft 23, driving sprockets 27 are fixed, and chains 29 are wound around between sub-sprockets 28 held on the upper portion of the stationary boards 19. The chain 29 and the elevation support member 15 are connected with couplers 30. The elevation support member 15 is thus moved to a predetermined height of position by driving the chain 29 with the DC motor 25. Accordingly, a desired developing unit 7 can be positioned to face the photoconductor 6.

Each developing unit 7 placed on the developing unit support board 17 is biased backward by a spring 31 and is stopped at a predetermined retreated position by an unillustrated stopper. At the back end portion of the developing unit 7, a flat spring 32 which is bended in shape is fixed.

FIG. 1 shows a state when the uppermost developing unit 7*y* is positioned opposite to the photoconductor 6, where a developing unit position switching means 33 is provided at the back of the developing unit 7*y* for advancing the developing unit 7 to the developer supply location opposite to the photoconductor 6.

Figure 8:
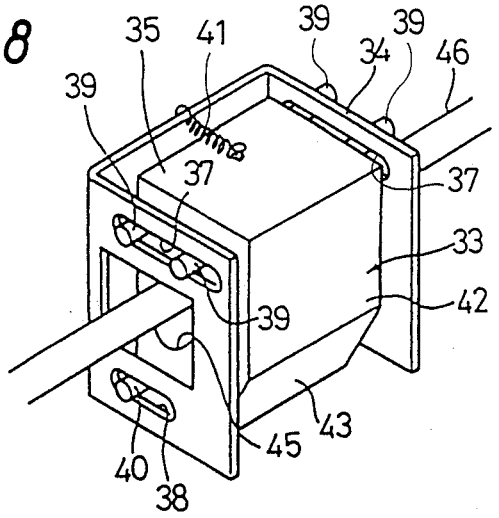
FIG. 8 is an enlarged perspective view showing a guide means which changes the positions of a developing unit between a location of operation and a location of non-operation.

The developing unit position switching means 33 is provided with, as shown in FIG. 8, a stationary frame 34 fixed to the main body of the machine, a moving cam 35 movably supported and guided back and forth by guiding long grooves 37, 38 with guide pins 39, 40, and an eccentric driver 36 for moving the moving cam 35 back and forth.

The front of the moving cam 35 is formed by a vertical plane 42 at the upper portion and an inclined plane 43 at the lower portion. The moving cam 35 is provided with hollow portion 45 where the eccentric driver 36 is positioned, and the front wall of the hollow portion 45 is pressed to contact the eccentric driver 36 by a spring 41 to move the moving cam 35 back and forth by rotation of the driver 36. The eccentric driver 36 is fixed to a cam driving shaft 46, and the cam driving shaft 46 is rotatively controlled by an unillustrated motor and clutch.

Figure 9:
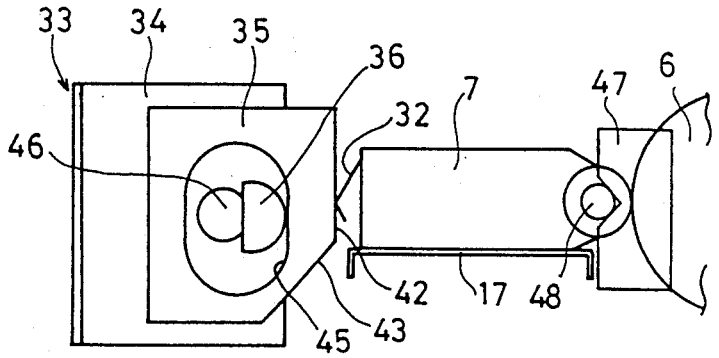
FIGS. 9 and 10 are side views showing the states of action of a guide means.
Figure 10:
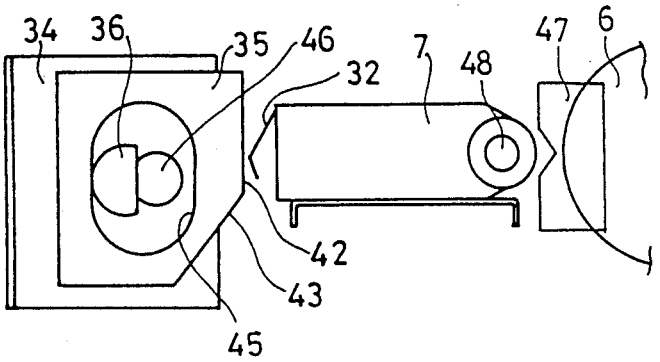

In order to accurately position the developing unit 7 directed to a developer supply position at the developer supply location, position regulating members 47 provided with V shape positioning grooves are disposed on both sides of the photoconductor 6, and positioning rollers 48 are fixed on both sides of the developing unit 7 as shown in FIGS. 2, 9 and 10. Accordingly, when the developing unit 7 is advanced by the eccentric driver 36 through the moving cam 35, the developing unit 7 is accurately positioned at the developer supply location by the positioning rollers 48 and the position regulating member 47 as shown in FIG. 9. When the eccentric driver 36 is retreated, the developing unit 7 is also retreated and engagement with the position regulating member 47 is released thereby making the developing unit free to move upwardly and downwardly as shown in FIG. 10.

Figure 3:
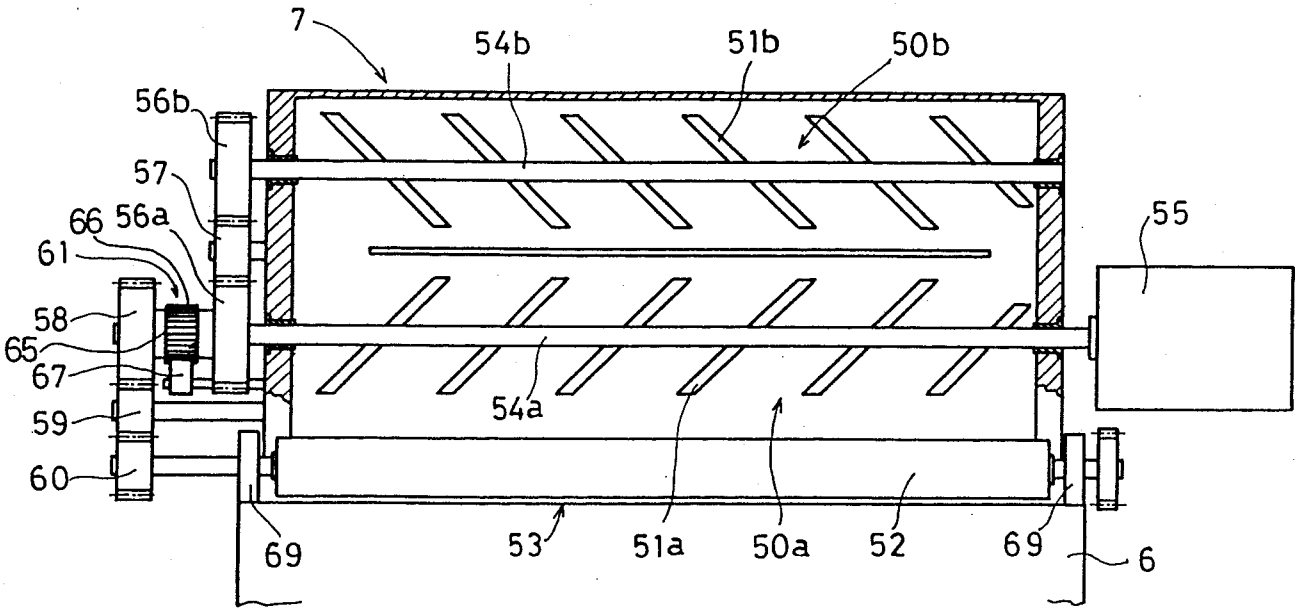
FIG. 3 is an expanded plan view, partially in cross-section, illustrating a developing unit of a developing device.

As illustrated in detail in FIG. 3, a developing unit 7 supplies developer to a developing roll 52 from bucket sections 50*a*, 50*b* provided with stirring means 51*a*, 51*b*. The developing roll 52 rotates the developer by magnets stored and fixed therein (not illustrated) under the state that the developer is attracted by the magnets. Accordingly, the developer is transported to the developing section opposite to the photoconductor 6 by the developing roll 52, wherein the amount of the developer passing through is regulated constant by an unillustrated height regulating plate for developing process. The developer used for developing process is transported into a developing unit 7 by rotation of the developing roll 52 and is removed at non-magnetic portion in the developing roll 52 and is then returned to the bucket section 50*a* again. The developer is thereafter mixed and stirred with new developer and is supplied to the developing roll 52 again. The stirring means 51*a* is driven by a developing motor 55 connected to one end of a rotative shaft 54*a*.

A transmission gear 56*a* and 56*b* are engaged through an idle gear 57 with another end of the rotative shaft 54*a* and one end of a rotative shaft 54*b* of the stirring means 51*b*. Accordingly, the stirring means 51*b* is also rotatively driven in the same direction correlatively with the stirring means 51*a*.

At the other end of the rotative shaft 54*a*, an interlocking gear 58 is rotatively mounted. The interlocking gear 58 is connected with the transmission gear 56*a* through a spring clutch 61 and is engaged with a developing roller gear 60 fixed to another end of a developing roll 52 through an idle gear 59. The developing roll 52 is thus rotated correlatively with the stirring means 54*a* when the spring clutch 61 is turned on.

Figure 4:
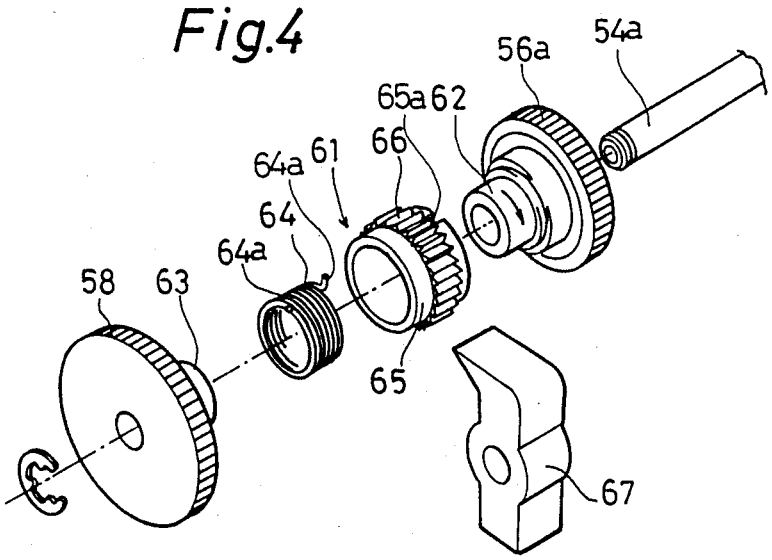
FIGS. 4 and 5 are an exploded perspective view and a partial sectional view showing a clutch provided in a driving system of a developing roll.
Figure 5:
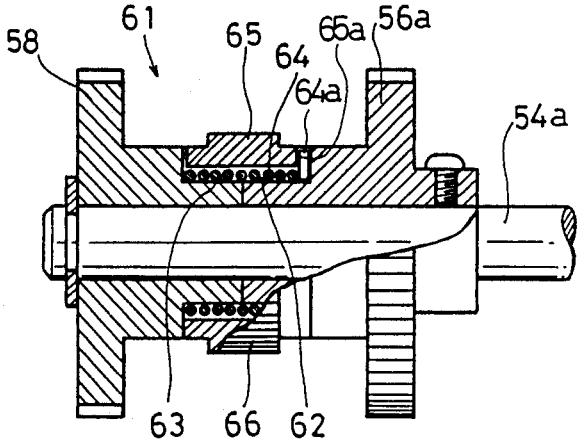

As shown in FIGS. 4 and 5, the spring clutch 61 is fitted on driving cylindrical surface 62 and the sub-driving cylindrical surface 63 formed on the circumferential portions adjacent to the transmission gear 56*a* and the interlocking gear 58 with a spring 64 closely contacted.

A coupling ring 65 is fitted on the circumference of the spring 64. One end 64*a* of the spring 64 on the side of the driving cylindrical surface 62 is hooked at a notched portion 65*a* of the coupling ring 65. A ratchet 66 is formed on the circumference of the coupling ring 65, and a claw 67 which engages with the ratchet 66 is pivotally mounted on the side of the developing unit 7.

Under the state when the claw 67 is engaged with the ratchet 66 and the action of the coupling ring 65 is obstructed, one end 64*a* of the spring 64 is fixed and the spring is not rotated. At this stage, even the driving cylindrical surface 62 is rotated in the direction of arrow in FIG. 4 and one end 64*a* of the spring 64 is moved in the direction of the spring to be tightened with a rotational friction between the driving cylindrical surface 62, the action of the spring is obstructed by the coupling ring 65. Accordingly, the spring 64 is not wound tight and is slidably kept under stopping state between the driving cylindrical surface 62. The driving cylindrical surface 62 is thus raced and rotation is not transmitted to the side of the sub-driving cylindrical surface 63.

On the other hand, when the claw 67 is moved to a disengaged position, the coupling ring 65 becomes freely rotatable and the obstruction to one end 64*a* of the spring 64 is released. At this stage, if the driving cylindrical surface 62 is rotated in the direction of arrow in FIG. 4, the end 64*a* of the spring 64 can be moved in the direction of spring tightened with the coupling ring 65 by the friction between the spring 64. Accordingly, the spring 64 is tightened and wound around the driving cylindrical surface 62 and the sub-driving cylindrical surface 63 thereby transmitting the force of rotation of the driving cylindrical surface 62 to the sub-driving cylindrical surface 63.

Figure 6:
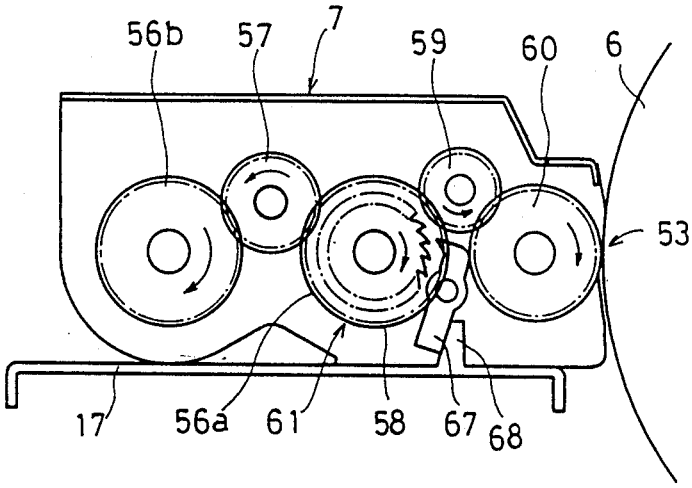
FIGS. 6 and 7 are side views illustrating the states when a developing unit is positioned at a developing location opposite to a photoconductor and when a developing unit is not positioned at the developing location.
Figure 7:
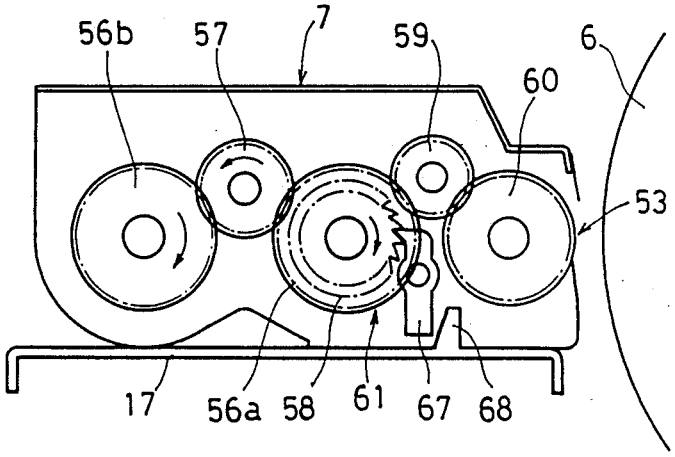

As shown in FIG. 6, a protrusion 68 is formed on the developing unit support board 17 for contacting the claw 67. The protrusion 68 sways the claw 67 to a disengaged position at the state where developing unit 7 is positioned at the developer supply location and permits it to return to an engaged position at the retreated position as shown in FIG. 7.

In FIG. 3, a simplified developing unit positioning means by rollers 69 are illustrated. The rollers 69 are disposed on both sides of the developing roll 52 and position the developing unit 7 at the developer supply location by contacting both end portions of the photoconductor 6.

The function of the device will now be described. The elevation support member 15 is first moved to have a desired color developing unit 7 positioned at a developing position opposite to the photoconductor 6. Then, the developing unit 7 at the developing position is pressed and advanced by a position switching means 33 to position at the developer supply location adjacent to the photoconductor 6. At this stage, the claw 67 contacts the protrusion 68 with downward movement of the developing unit 7 as shown in FIG. 6. Accordingly, the coupling ring 65 is freed and the spring clutch 64 is turned on.

Under the state, the rotation of the developing motor 55 is transmitted to the stirring means 51*a* and 51*b* of the bucket sections 50, 50*b* and the developing roll 52 respectively. Consequently, developer is stirred and circulated in the bucket sections 50*a* , 50*b* and is supplied to the developing roll 52. With the rotation of the developing roll 52, a predetermined amount of developer is fed to a developing section 53 and a latent image on the photoconductor is visualized by toner. The visualized toner image is then transferred onto a copy paper on the transfer drum 8.

After the developing process by the developing unit 7, the developing unit 7 is released from the pressure by position switching means 33, and the developing unit is moved backward by the spring 31. Then, the claw 67 is separated from the protrusion 68 and is engaged with the ratchet 66 as shown in FIG. 7. As a result, the coupling ring 65 is stopped and the spring clutch 61 is turned off. Accordingly, the rotation of the driving motor 55 is no longer transmitted to the developing roll, and only the stirring means 51*a*, 51*b* are driven by the developing motor 55.

In such a manner, the control for driving the developing roll 52 and the stirring means 51*a*, 51*b* together at the time of developing process, and the control for stopping the developing roll 52 and continuously driving the stirring means 51*a*, 51*b* at the time of non-developing process can be carried out automatically correlatively with the position switching action of the developing unit 7 without requiring a special actuator and its control means.

The present invention is not limited to the elevation method and is applicable to a moving method such as the rotary method. Moreover, it is also applicable to a fixed method wherein a developing unit is arranged to be moved at the time of developing process and non-developing process.

Not limiting to the spring clutch 61, any proper clutch may be utilized. Further, not limited to a color copying machine, it may also be applied to a multicolor copying machine when a plurality of developing units accommodating different colored developers are selectively used for visualizing the electrostatic latent images formed separately without having color decomposition.

Not limiting to copying machines, it may be applied to laser beam printers which perform the similar image forming action.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A developing device for developing an electrostatic latent image on an image support member, comprising:

a plurality of developing units for supplying different colored developers to the image support member, each said developing unit having a developing roll which is rotatively driven for supplying the developer to the image support member and a developer stirring means which is rotatively driven for stirring and supplying the developer to the developing roll;

a driving source for rotatively driving the developing roll and the developer stirring means;

a driving force transmitting means provided between the driving source and both the developing roll and the developer stirring means for transmitting a driving force from the driving source to the developing roll and the developer stirring means;

a disconnecting means provided at a transmission part to the developing roll in the driving force transmitting means for disconnecting or connecting only a driving force transmission from the driving source to the developing roll;

a position switching means for switching over positions of each developing unit between a developer supply location adjacent to the image support member and a developer non-supply position away from the image support member; and an interlocking means for actuating the disconnecting means to disconnect the driving force transmission when a developing unit is in the developer non-supply position or to connect the driving force transmission when the developing unit is in the developer supply location.

2. A developing device as defined in claim 1, wherein the driving force transmitting means connects the driving source with the developing roll and the developer stirring means by gears, and the disconnecting means being mounted in a part of the gears, and said interlocking means including a lever member for actuating the disconnecting means.

3. A developing device as defined in claim 1, wherein the position switching means comprises:

a movable support member for supporting the developing units and being moved to a predetermined direction for selectively switching over the position of one of the developing units to a developing location opposite to the image support member; and a mechanism of forward and backward movement of a developing unit on the movable support member for advancing a developing unit at a developing position to the developer supply location adjacent to the image support member and for moving backward the unit from the developer supply location.

4. A developing device as claimed in claim 3, wherein the driving force transmitting means connects the driving source with the developing roll and the developer stirring means by gears, and the disconnecting means being mounted in a part of the gears, and said interlocking means including a lever member to connect or disconnect the disconnecting means.

5. A developing device as claimed in claim 3, wherein the driving force transmitting means connects the driving source with the developing roll and the developer stirring means by gears, and the disconnecting means being mounted in a part of the gears, and said interlocking means including a lever member for actuating the disconnecting means, and said movable support member moving reciprocatingly in the vertical direction.

6. A developing device for developing an electrostatic latent image on an image support member, comprising:

a plurality of developing units for supplying different colored developers to the image support member, each said developing unit having a developing roll which is rotatively driven for supplying the developer to the image support member and a developer stirring means which is rotatively driven for stirring and supplying the developer to the developing roll;

a driving source for giving a driving force to the developer stirring means;

a driving force transmitting means capable of rotating the developer stirring means and the developing roll in an interlocking relation;

a position switching means for switching over positions of each developing unit between a developer supply location adjacent to the image support member and a developer non-supply position away from the image support member; and a driving force switching means for switching the driving force transmitting means between a state where the developer stirring means is driven correlatively with the developing roll in the developer supply location and a state where the developer stirring means is only driven in the developer non-supply position.

7. A developing device as defined in claim 6, wherein the position switching means comprises:

a movable support member for supporting the developing units and being moved to a predetermined direction for selectively switching over the position of one of the developing units to a developing location opposite to the image support member; and a mechanism of forward and backward movement of a developing unit on the movable support member for advancing a developing unit at a developing location to the developer supply location adjacent to the image support member and for moving backward the unit from the developer supply location.

8. A developing device as defined in claim 7, wherein the driving force transmitting means connects the driving source with the developing roll and the developer stirring means by gears, and the driving force switching means including a driving force switching member mounted in a part of the gears and a lever member for actuating the driving force switching member.

9. A developing device as defined in claim 7, wherein the movable support member is reciprocatingly moved in the vertical direction.

10. A developing device as defined in claim 9, wherein the driving force transmitting means connects the driving source with the developing roll and the developer stirring means by gears, and the driving force switching means including the driving force switching member mounted in a part of the gears and a lever member for actuating the driving force switching member.

11. A developing device for developing an electrostatic latent image on an image support member, comprising:

a plurality of developing units for supplying different colored developers to the image support member, each said developing unit having a developing roll which is rotatively driven for supplying the developer to the image support member and a developer stirring means which is rotatively driven for stirring and supplying the developer to the developing roll;

a driving source for rotatively driving the developing roll and the developer stirring means;

a driving force transmitting means connected to the driving source with the developing roll and the developer stirring means by gears for transmitting a driving force from the driving source to the developing roll and the developer stirring means;

a disconnecting means provided at a part of the gears for disconnecting or connecting only a driving force transmission from the driving source to the developing roll;

a position switching means for switching over the position of each developing unit between a developer supply location adjacent to the image support member and a developer non-supply position away from the image support member, said position switching means having a movable support member for supporting the developing units and being moved to a predetermined direction for selectively switching over the position of one of the developing units to a developing position opposite to the image support member, and having a mechanism of forward and backward movement of a developing unit on the movable support member for advancing a developing unit at the developing position to the developer supply location adjacent to the image support member and for moving backward the unit from the developer supply location; and an interlocking means having a protrusion fixed on the movable support member and a lever member being supported by a developing unit together with the gears and the disconnecting means, said lever member actuating the disconnecting means to disconnect a driving force transmission when the developing unit is advanced to the developer supply location and the lever member contacts with the protrusion, or to disconnect driving force transmission when the developing unit is moved backward from the developer supply location and the lever member separates from the protrusion on the movable support member.

12. A developing device as claimed in claim 11, wherein the movable support member is reciprocatingly moved in the vertical direction.

13. A developing device for developing an electrostatic latent image support member, comprising:

a plurality of developing units for supplying different colored developers to the image support member, each said developing unit having a developing roll which is rotatively driven for supplying the developer to the image support member and a developer stirring means which is rotatively driven for stirring and supplying the developer to the developing roll;

a driving source for rotatively driving the developing roll and the developer stirring means;

a driving force transmitting means connects the driving source with the developing roll and the developer stirring means by gears for transmitting the driving force from the driving source to the developing roll and the stirring means;

a disconnecting means provided at a part of the gears for disconnecting or connecting only a driving force transmission from the driving source to the developing roll;

a position switching means for switching over positions of each developing unit between a developer supply location adjacent to the image support member and a developer non-supply position away from the image support member, said position switching means having a movable support member for supporting the developing units and being moved to a predetermined direction for selectively switching over the position of one of the developing units to a developing position opposite to the image support member, and having a mechanism of forward and backward movement of a developing unit on the movable support member for advancing a developing unit at the developing position to the developer supply location adjacent to the image support member and for moving backward the unit from the developer supply location, and said movable support member is reciprocatingly moved in the vertical direction; and an interlocking means having a protrusion fixed on the movable support member and a lever member being supported by a developing unit together with the gears and the disconnecting means, said lever member actuates the disconnecting means to connect a driving force transmission when the developing unit is advanced to the developer supply location and the lever member contacts with the protrusion, or to disconnect the driving force transmission when the developing unit is moved backward from the developer supply location and the lever member separates from the protrusion on the movable support member.

14. A developing device for developing an electrostatic latent image support member, comprising:

a plurality of developing units for supplying different colored developers to the image support member, each said developing unit having a developing roll which is rotatively driven for supplying the developer to the image support member and a developer stirring means which is rotatively driven for stirring and supplying the developer to the developing roll;

a driving source for giving a driving force to a developer stirring means;

a driving force transmitting means capable of rotating the developer stirring means and the developing roll in an interlocking relation, said driving force transmitting means connects the driving source with the developing roll and the developer stirring means by gears;

a disconnection means provided at a part of the gears for disconnecting only a driving force transmission from the driving source to the developing roll;

a position switching means for switching over the position of each developing unit between a developer supply location adjacent the image support member and a developer non-supply position away from the image support member, and said position switching means having a movable support member for supporting the developing units and being moved to a predetermined direction for selectively switching over the position of one of the developing units to a developing location opposite to the image support member and a mechanism of forward and backward movement of a developing unit on the movable support member for advancing a developing unit at a developing location to the developer supply location adjacent the image support member and for moving backward the unit from the developer supply location; and a driving force switching means for switching the driving force transmitting means between a state where the developer stirring means is driven correlatively with the developing roll in the developer supply location and a state where the developer stirring means is only driven in the developer non-supply position, said driving force switching means including a driving force switching member mounted in a part of the gears, a lever member for actuating the driving force switching member and a protrusion fixed on the movable support member, said lever member being supported by a developing unit together with the gears and the driving force switching member for actuating the driving force switching member to connect a driving force transmission when the developing unit is advanced to the developer supply location and the lever member contacts with the protrusion, or to disconnect the driving force transmission when the developing unit is moved backward from the developer supply location and the lever member separates from the protrusion on the movable support member.

15. A developing device for developing an electrostatic latent image on an image support member, comprising:

a plurality of developing units for supplying different colored developers to the image support member, each said developing unit having a developing roll which is rotatively driven for supplying the developer to the image support member and a developer stirring means which is rotatively driven for stirring and supplying the developer to the developing roll;

a driving source for giving a driving force to a developer stirring means;

a driving force transmitting means capable of rotating the developer stirring means and the developing roll in an interlocking relation, said driving force transmitting means connects the driving force with the developing roll and the developer stirring means by gears, a disconnecting means provided at a part of the gears for disconnecting only a driving force transmission from the driving source to the developing roll;

a position switching means for switching over the position of each developing unit between a developer supply location adjacent to the image support member and a developer non-supply position away from the image support member, and said position switching means having a movable support member for supporting the developing units and being moved to a predetermined direction for selectively switching over the position of one of the developing units to a developing location opposite the image support member, and having a mechanism of forward and backward movement of a developing unit on the movable support member for advancing a developing unit at a developing location to the developer supply location adjacent to the image support member and for moving backward the unit from the developer supply location, and said movable support member is reciprocatingly moved in the vertical direction;

a driving force switching means for switching the driving force transmitting means between a state where the developer stirring means is driven correlatively with the developing roll in the developer supply location and a state where the developer stirring means is only driven in the developer non-supply position, said driving force switching means including a driving force switching member mounted in a part of the gears, a lever member for actuating the driving force switching member and a protrusion fixed on the movable support member, said lever member being supported by a developing unit together with the gears and the driving force switching member for actuating the driving force switching member to connect a driving force transmission when the developing unit is advanced to the developer supply location and the lever member contacts with the protrusion, or to contact the driving force transmission when the developing unit is moved backward from the developer supply location and the lever member separates from the protrusion on the movable support member.

* * * * *

UNITED STATES PATENT AND TRADEMARK OFFICE

CERTIFICATE OF CORRECTION

PATENT NO. : 4,958,191

DATED : September 18, 1990

INVENTOR(S) : Takanobu Yamada, et al.

It is certified that error appears in the above-identified patent and that said Letters Patent is hereby corrected as shown below:

In col. 6, line 43, change "downward" to --forward--.

In col. 10, lines 5 and 6 (claim 11, lines 44 and 45), change "disconnect" to --connect--.

In col. 10, line 9 (claim 11, line 48), after "disconnect", insert --the--.

In col. 12, line 59 (claim 15, line 59), change "contact" to --disconnect--.

Signed and Sealed this

Twenty-fourth Day of December, 1991

*Attest:*

HARRY F. MANBECK, JR.

*Attesting Officer*

*Commissioner of Patents and Trademarks*